US008448580B2

(12) United States Patent
Liu et al.

(10) Patent No.: US 8,448,580 B2
(45) Date of Patent: May 28, 2013

(54) FREIGHT CAR BOGIE AND FREIGHT CAR

(75) Inventors: Zhenming Liu, Heilongjiang (CN); Chunlin Wang, Heilongjiang (CN); Haibin Hu, Heilongjiang (CN); Shuming Xing, Heilongjiang (CN); Pingwei Yin, Heilongjiang (CN); Hai Yao, Heilongjiang (CN)

(73) Assignees: Qiqihar Railway Rolling Stock Co., Ltd., Heilongjiang (CN); Dalian Qiche Railway Rolling Stock Co., Ltd., Liaoning (CN)

( * ) Notice: Subject to any disclaimer, the term of this patent is extended or adjusted under 35 U.S.C. 154(b) by 28 days.

(21) Appl. No.: 13/165,724

(22) Filed: Jun. 21, 2011

(65) Prior Publication Data

US 2011/0247520 A1 Oct. 13, 2011

Related U.S. Application Data

(63) Continuation of application No. PCT/CN2010/073307, filed on May 27, 2010.

(30) Foreign Application Priority Data

Nov. 27, 2009 (CN) ..... 2009 1 0225680

(51) Int. Cl.
*B61D 1/00* (2006.01)

(52) U.S. Cl.
USPC ..... 105/167

(58) Field of Classification Search
None
See application file for complete search history.

(56) References Cited

U.S. PATENT DOCUMENTS

| | | | | |
|---|---|---|---|---|
| 4,428,301 | A * | 1/1984 | Jackson | 105/168 |
| 6,910,426 | B2 | 6/2005 | Krishnaswami | 105/167 |

FOREIGN PATENT DOCUMENTS

| | | | |
|---|---|---|---|
| AU | 200047216 | B3 | 7/2000 |
| AU | 2010324390 | B2 | 9/2012 |
| CN | 2230260 | | 7/1996 |
| CN | 2388083 | | 7/2000 |
| CN | 2910705 | | 6/2007 |
| CN | 100429104 | | 10/2008 |
| CN | 201347085 | | 11/2009 |
| CN | 101700775 | | 6/2011 |
| DE | 692777 | | 6/1940 |
| DE | 871697 | | 3/1953 |
| GB | 14039 | | 0/1914 |

OTHER PUBLICATIONS

International Search Report of International Application No. PCT/CN2010/073307, dated Sep. 2, 2010.

* cited by examiner

*Primary Examiner* — R. J. McCarry, Jr.
(74) *Attorney, Agent, or Firm* — J.C. Patents

(57) ABSTRACT

The present invention discloses a freight car bogie and a freight car. The freight car bogie comprises two wheel sets, two side frames arranged at outer side of said wheel sets, and a bolster fixedly connected to center position of each of said two side frames, respectively. The freight car bogie further comprises a K-shaped supporting device, wherein said K-shaped supporting device passes through preset holes on two sides of an abdominal region of said bolster; a first upper end and a second upper end, as well as a first lower end and a second lower end of said K-shaped supporting device are elastically connected with said two side frames respectively; and said first upper end and second upper end, and said first lower end and second lower end are respectively symmetrical with respect to a center line of said bolster. The K-shaped supporting device of the present application may not pass through the middle part of the bolster so that a reinforcing rib for bearing vertical load can be disposed on the middle part of the bolster, thereby increasing the anti-lozenge-distortion rigidity of the bogie as well as improving the strength of the bolster for bearing the vertical load.

20 Claims, 6 Drawing Sheets

FREIGHT CAR BOGIE AND FREIGHT CAR

CROSS-REFERENCE TO RELATED APPLICATIONS

This application is a continuation of International Application No. PCT/CN2010/073307 filed on May 27, 2010, which claims the priority benefit of China Patent Application No. 200910225680.6, filed on Nov. 27, 2009. The contents of the above identified applications are incorporated herein by reference in their entirety.

FIELD OF THE TECHNOLOGY

The present invention relates to railway transportation equipment, in particular to a freight car bogie and a freight car.

BACKGROUND

Currently, a freight car generally includes a car body, a bogie, a brake rigging, a coupler draft gear, etc. The bogie is used for supporting the car body, guiding the freight car to run along rails, and bearing various loads from the car body and the rails. The most common bogie in the railway freight car is a three-piece two-axle bogie, which includes a bolster, two side frames, two wheel sets, a spring damper device and a brake rigging.

However, the anti-lozenge-distortion rigidity of the three-piece two-axle bogie is low, and the critical speed during curve negotiation is not high. Aiming at the above disadvantages of the three-piece two-axle bogie, a cross-braced type three-piece two-axle bogie is commonly adopted. An elastic crossing rod connection is additionally arranged between two side frames of this cross-braced type three-piece two-axle bogie, thereby increasing the capability of resisting displacement between the two side frames, and improving the anti-lozenge-distortion rigidity of the bogie. Currently, a central cross-braced type three-piece two-axle bogie is mainly applied in the freight car. FIG. 1 is a top view of the central cross-braced type three-piece two-axle bogie in the prior art. As shown in FIG. 1, the bogie comprises wheel sets, side frames, a bolster, a spring damper device, a brake rigging, a spring, an adapter, a cross-braced device and the like, wherein 'X'-shaped two connecting rods pass through preset holes in the middle of the abdominal region of the bolster, two ends of each connecting rod are connected with the two side frames to form a connecting rod mechanism, and two ends of each side frame are supported on the wheel sets by an journal box rubber pad and the adapter. A pair of connecting rods are arranged between the two side frames, thus improving the anti-lozenge-distortion rigidity of the bogie as well as the dynamic performance of the car.

FIG. 2 is a three-dimensional structural schematic diagram of the bolster of the central cross-braced type three-piece two-axle bogie in the prior art, and FIG. 3 is a cross-section schematic diagram of the middle part of the bolster of the central cross-braced type three-piece two-axle bogie in the prior art. As shown in FIG. 2 and FIG. 3, the two connecting rods pass through the abdominal cavity of the bolster and intersected at the middle part of the abdominal cavity, so that the middle part of the bolster is a cavity. During the running of the bogie carrying the freight car body, the bolster mainly bears the vertical load applied to a center plate. The vertical load only can be transferred by side walls since the middle part of the bolster is a cavity, and the strength of the bolster for bearing the vertical load is very weak. Therefore, in order to guarantee the strength of the bolster for bearing the vertical load, the thicknesses of the side walls in the middle part of the bolster need to be increased, so that the weight of the bolster is largely increased, accordingly the whole weight of the freight car is increased, and the effective load of the freight car is reduced.

SUMMARY

It is an object of the present invention to provide a freight car bogie and a freight car. A K-shaped supporting device passing though preset holes on two sides of the abdominal region of a bolster is adopted, and it may not pass through the middle part of the bolster so that a reinforcing rib for bearing vertical load can be disposed on the middle part of the bolster, thereby increasing the anti-lozenge-distortion rigidity of the bogie as well as improving the strength of the bolster for bearing the vertical load.

In order to achieve the above object, the present invention provides a freight car bogie, which comprises two wheel sets, two side frames arranged at outer side of the wheel sets, and a bolster fixedly connected to center position of each of the two side frames, respectively. The freight car bogie further comprises a K-shaped supporting device, wherein the K-shaped supporting device passes through preset holes on two sides of an abdominal region of the bolster; a first upper end and a second upper end, as well as a first lower end and a second lower end of the K-shaped supporting device are elastically connected with the two side frames respectively; and the first upper end and second upper end, and the first lower end and second lower end are respectively symmetrical with respect to a centre line of the bolster.

In the freight car bogie, each of the two side frames is fixedly provided with two support brackets which are symmetrical with respect to the centre line of the bolster, and the first upper end and second upper end, and the first lower end and second lower end are elastically connected with four support brackets, respectively.

In the freight car bogie, the four support brackets are welded or riveted with the side frames.

In the freight car bogie, a plane in which the K-shaped supporting device is positioned is close to and parallel with a plane in which center lines of axles of the two wheel sets are positioned.

In the freight car bogie, the bolster is provided with a reinforcing rib in a middle part thereof, and the reinforcing rib is positioned in a middle position between the preset holes on two sides of the abdominal region of the bolster.

In the freight car bogie, the K-shaped supporting device comprises a first connecting rod, a second connecting rod and a third connecting rod, wherein one end of the first connecting rod is the first upper end, one end of the second connecting rod is the first lower end, tow ends of the third connecting rod are the second upper end and the second lower end respectively, and the other end of the first connecting rod and the other end of the second connecting rod are elastically connected with the middle part of the third connecting rod, respectively.

In the freight car bogie, the third connecting rod has a through hole in the middle part thereof, for accommodating the other end of the first connecting rod and the other end of the second connecting rod therein, so that the other end of the first connecting rod and the other end of the second connecting rod overlap with each other.

In the freight car bogie, the elastic connection is a bolted connection via a screw hole, a bolt and a nut, and a cotter pin is inserted below the nut to prevent the bolt from loosening.

In order to achieve the above object, the present invention further provides a freight car, which comprises a car body and a bogie, wherein the bogie is the freight car bogie as mentioned above.

As can be seen from the above technical solution, by adopting the K-shaped supporting device passing through the preset holes on two sides of the abdominal region of the bolster, the freight car bogie and the freight car of the present invention have the following beneficial effects:

1. the present invention can prevent the bogie from the lozenge distortion by adopting the K-shaped supporting device, and thereby improve the running stability of the car;

2. the present invention optimizes the structure of the bolster since the K-shaped supporting device passes through the preset holes on two sides of the abdominal region of the bolster, and improves the strength of the bolster for bearing the vertical load by additionally arranging the reinforcing rib in the middle part of the bolster; and 3. the present invention reduces the deadweight of the whole freight car due to the use of the reinforcing rib.

The technical solution of the invention will be further described in detail with reference to the drawings and embodiments.

Reference signs:

| | | | |
|---|---|---|---|
| 1 | wheel set | 2 | side frame |
| 3 | bolster | 4 | K-shaped supporting device |
| 41 | first upper end | 42 | second upper end |
| 43 | first lower end | 44 | second lower end |
| 5 | support bracket | 6 | axel of wheel set |
| 7 | reinforcing rib | 8 | preset hole |
| 9 | first connecting rod | 92 | bolt connecting hole |

-continued

Reference signs:

| | | | |
|---|---|---|---|
| 91 | the other end of the first connecting rod | 113 | bolt connecting hole |
| 10 | second connecting rod | 13 | bolt |
| 101 | the other end of the second connecting rod | 15 | cotter pin |
| 11 | third connecting rod | | |
| 111 | the middle part of the third connecting rod | | |
| 112 | through hole | | |
| 12 | rubber bush | | |
| 14 | nut | | |

DETAILED DESCRIPTION

The present invention provides a freight car bogie, which comprises two wheel sets, two side frames arranged at outer side of the wheel sets, and a bolster fixedly connected to the center positions of the two side frames. The freight car bogie further comprises a K-shaped supporting device, wherein the K-shaped supporting device passes through preset holes on two sides of the abdominal region of the bolster; a first upper end and a second upper end, as well as a first lower end and a second lower end of the K-shaped supporting device are elastically connected with the two side frames respectively; and the first upper end and the second upper end, as well as the first lower end and the second lower end are respectively symmetrical with respect to the centre line of the bolster. The present invention can prevent the bogie from the lozenge distortion by adopting the K-shaped supporting device passing through preset holes on two sides of the abdominal region of the bolster, and thereby improve the running stability of the car. The present invention optimizes the structure of the bolster with the aid of the K-shaped supporting device passing through the preset holes on two sides of the abdominal region of the bolster, so that the K-shaped supporting device does not pass through the middle part of the bolster, and a structure, which can improve the strength of the bolster for bearing the vertical load, is additionally arranged in the middle part of the bolster. Thereby, the present invention reduces the deadweight of the whole freight car without the requirement of increasing the wall thickness of the bolster. Accordingly, the present invention can change the vertical and the horizontal dynamic performance of the car, improve the curve negotiation performance, increase the motion critical speed of the bogie, reduce the wear between wheel and rail, etc.

Figure 1:
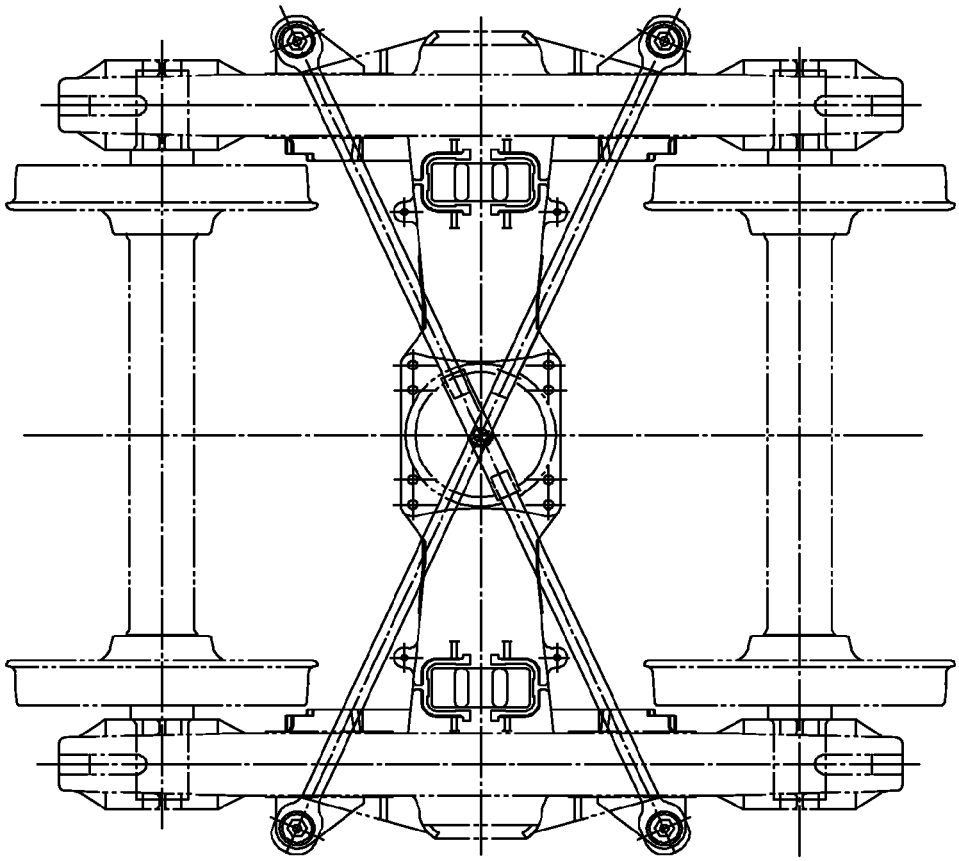
Figure 1 (PRIOR ART)
FIG. 1 is a top view of a central cross-braced type three-piece two-axle bogie in the prior art.
Figure 2:
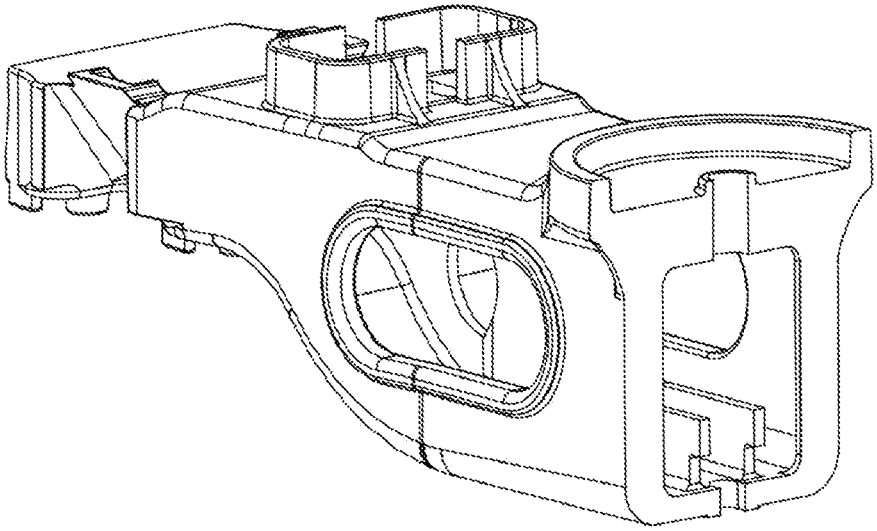
Figure 2 (PRIOR ART)
FIG. 2 is a three-dimensional structural schematic diagram of a bolster of the central cross-braced type three-piece two-axle bogie in the prior art.
Figure 3:
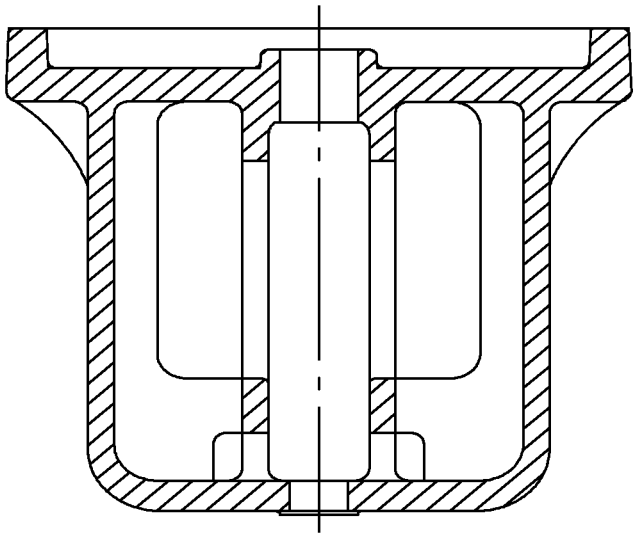
Figure 3 (PRIOR ART)
FIG. 3 is a cross-section schematic diagram of middle part of the bolster of the central cross-braced type three-piece two-axle bogie in the prior art.
Figure 4:
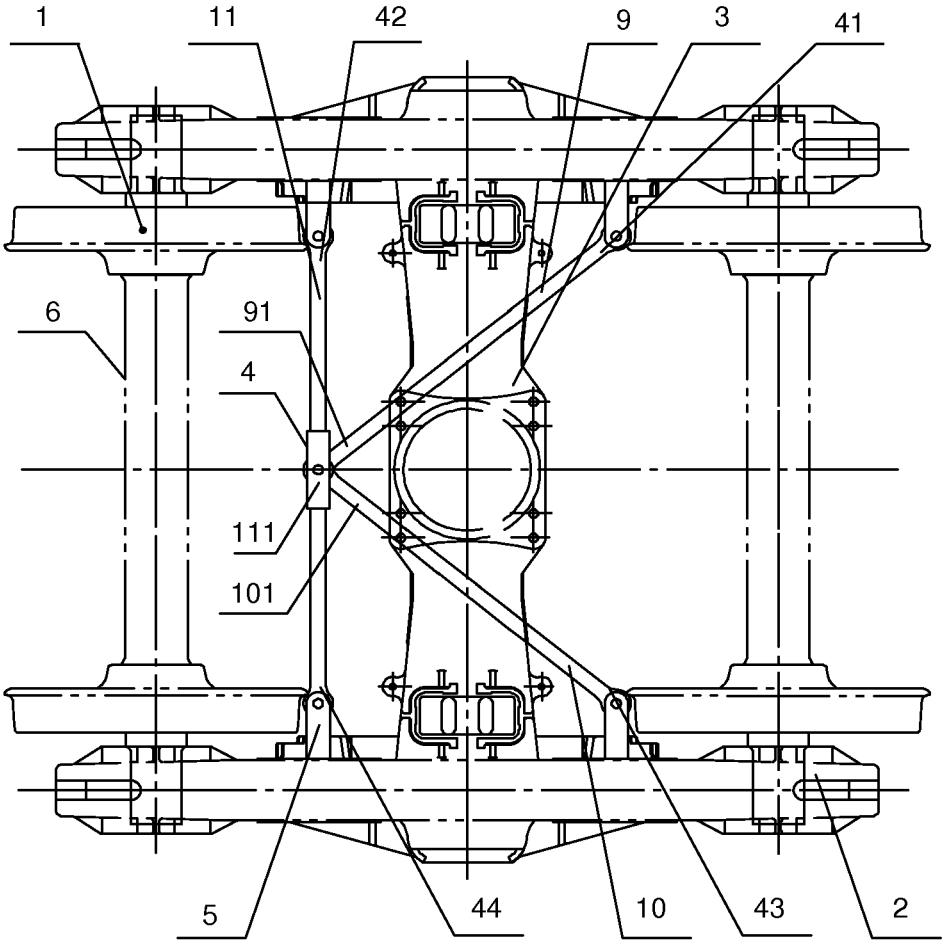
FIG. 4 is a structural schematic diagram of a freight car bogie of the present invention.
Figure 5:
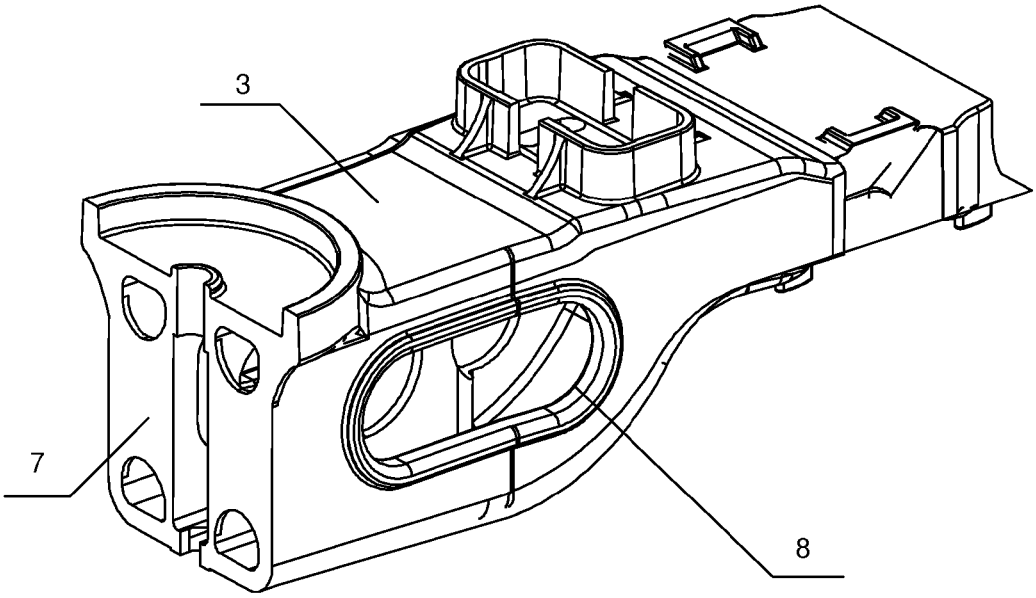
FIG. 5 is a three-dimensional structural schematic diagram of a bolster of the freight car bogie of the present invention.
Figure 6:
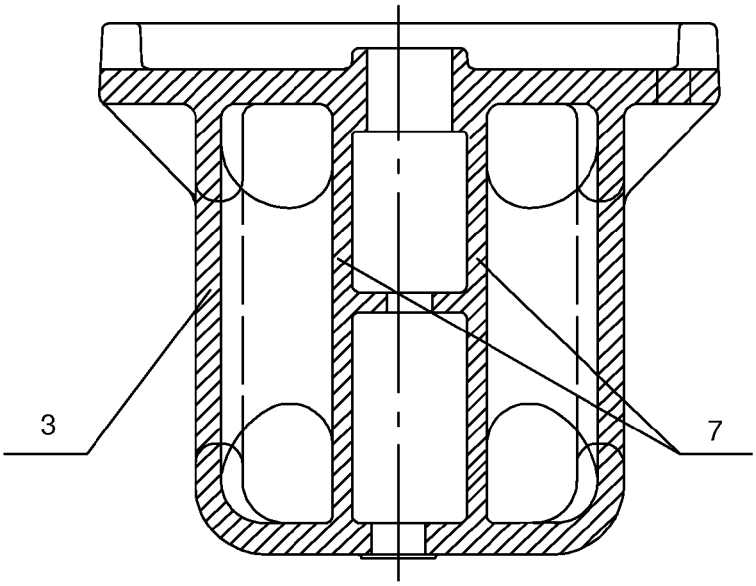
FIG. 6 is a cross-section schematic diagram of middle part of the bolster of the freight car bogie of the present invention.

FIG. 4 is a structural schematic diagram of a freight car bogie of the present invention; FIG. 5 is a three-dimensional structural schematic diagram of a bolster of the freight car bogie of the present invention; and FIG. 6 is a cross-section schematic diagram of middle part of the bolster of the freight car bogie of the present invention. Referring to FIGS. 4-6, the freight car bogie comprises two wheel sets 1, two side frames 2 arranged at outer side of the wheel sets 1, and a bolster 3 fixedly connected to the center positions of the two side frames 2. The freight car bogie further comprises a K-shaped supporting device 4 passing through preset holes 8 on two sides of the abdominal region of the bolster 3, and the preset holes 8 on two sides of the abdominal region of the bolster 3 do not pass through the central part of the bolster 3 and keep a certain distance with the central part. A first upper end 41 and a second upper end 42, as well as a first lower end 43 and a second lower end 44 of the K-shaped supporting device 4 are elastically connected with two side frames 2 respectively, and the first upper end 41 and the second upper end 42, as well as the first lower end 43 and the second lower end 44 are respectively symmetrical with respect to the centre line of the bolster. In addition, each of the two side frames 2 is further fixedly provided with two support brackets 5 which are symmetrical with respect to the centre line of the bolster 3, and the first upper end 41 and the second upper end 42, as well as the first lower end 43 and the second lower end 44 are elastically connected with the four support brackets 5 respectively. The four support brackets 5 can be welded or riveted with the two side frames 2. The method for fixed connection here is not limited to welding or riveting, and it also can be other methods for fixedly connecting the support brackets with the side frames.

The present invention can prevent the bogie from the lozenge distortion by adopting the K-shaped supporting device passing through preset holes on two sides of the abdominal region of the bolster, and thereby improve the running stability of the car. The present invention optimizes the structure of the bolster with the aid of the K-shaped supporting device passing through the preset holes on two sides of the abdominal region of the bolster of the freight car bogie, so that the K-shaped supporting device does not pass through the middle part of the bolster, and a structure, which can improve the strength of the bolster for bearing the vertical load, is additionally arranged in the middle part of the bolster. Thereby, the present invention reduces the deadweight of the whole freight car without the requirement of increasing the wall thickness of the bolster. The present invention solves the problems that the strength of the bolster for bearing the vertical load is very weak in the central cross-braced type three-piece two-axle bogie of the railway freight car in the prior art since the middle part of the abdominal cavity of the bolster is a cavity, thus the thicknesses of the side walls of the bolster are increased and the weight of the bolster is increased, and further the deadweight of the freight car is increased and the effective load is reduced in the prior art.

As shown in FIG. 4, a plane in which the K-shaped supporting device 4 is positioned is close to and parallel with a plane formed by the center lines of the axles 6 of the two wheel sets. The instillation plane for installing the K-shaped supporting device 4 on the support brackets 5 is close to the plane formed by the center lines of the axles 6 of the two wheel sets. Therefore, the load, which is applied to the plane formed by the center lines of the axles 6 of the two wheel sets and causes the lozenge distortion of the freight car bogie, can be reduced.

As shown in FIG. 5 and FIG. 6, a reinforcing rib 7 is arranged in the middle part of the bolster 3, and the reinforcing rib 7 is positioned in the middle position between the preset holes 8 on two sides of the abdominal region of the bolster 3. The reinforcing rib 7 can improve the capability of the bolster 3 for bearing the vertical load. The bolster 3 with this structure is more reasonable in terms of bearing the vertical force, and the wall thickness of the center part of the bolster 3 does not need to be increased to compensate the weak strength of the center part of the bolster 3, so that the weight of the bolster 3 can be reduced, and such bolster 3 is suitable for more occasions as required.

Due to the optimization of structure of the bolster, the present embodiment improves the strength of the bolster, thereby reduces the dead weight of the whole freight car, improves the effectively load of the car, and can solves the problems that the strength of the bolster for bearing the vertical load is very weak in the central cross-braced type bogie of the railway freight car in the prior art since the middle part of the abdominal cavity of the bolster is a cavity, thus the thicknesses of the side walls of the bolster are increased and the weight of the bolster is increased, and further the deadweight of the freight car is increased and the effective load is reduced in the prior art.

As shown in FIG. 4, the K-shaped supporting device 4 can particularly comprise a first connecting rod 9, a second connecting rod 10 and a third connecting rod 11, wherein one end of the first connecting rod 9 is the first upper end 41, one end of the second connecting rod 10 is the first lower end 43, two ends of the third connecting rod 11 are respectively the second upper end 42 and the second lower end 44, and the other end 91 of the first connecting rod 9 and the other end 101 of the second connecting rod 10 are respectively elastically connected with the middle part 111 of the third connecting rod 11.

Figure 7A:
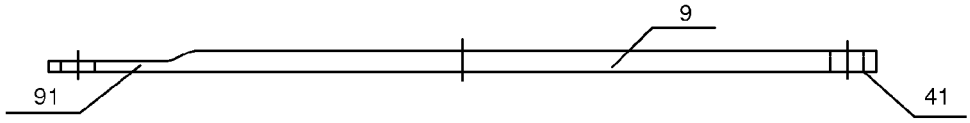
FIG. 7A is a main view of a first connecting rod of the freight car bogie of the present invention.
Figure 7B:
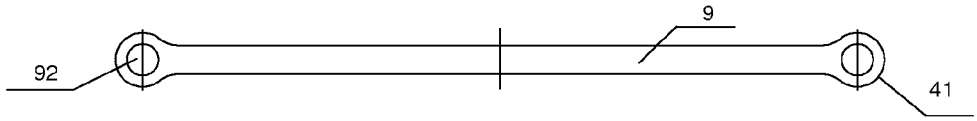
FIG. 7B is a top view of the first connecting rod of the freight car bogie of the present invention.

FIG. 7A is a main view of the first connecting rod 9 of the freight car bogie of the present invention, and FIG. 7B is a top view of the first connecting rod 9 of the freight car bogie of the present invention. The shape and the structure of the second connecting rod 10 are the same as those of the first connecting rod 9. As shown in FIG. 7A and FIG. 7B, the thickness of the other end 91 of the first connecting rod 9 may be thinner than that of the body of the first connecting rod 9, and two ends of the first connecting rod 9 are respectively provided with bolt connecting holes 92. Similarly, the thickness of the other end 101 of the second connecting rod 10 may be thinner than that of the body of the second connecting rod 10, and two ends of the second connecting rod 10 are also respectively provided with bolt connecting holes 92.

Figure 8A:
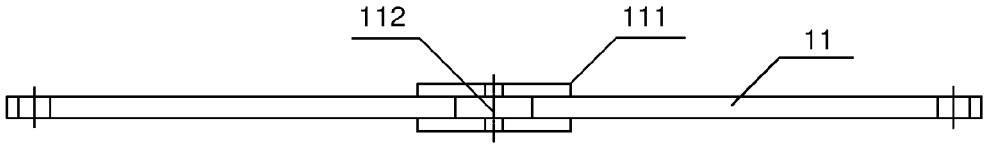
FIG. 8A is a main view of a third connecting rod of the freight car bogie of the present invention.
Figure 8B:
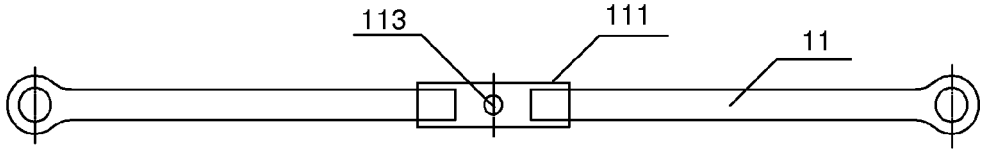
FIG. 8B is a top view of the third connecting rod of the freight car bogie of the present invention.

FIG. 8A is a main view of the third connecting rod 11 of the freight car bogie of the present invention, and FIG. 8B is a top view of the third connecting rod 11 of the freight car bogie of the present invention. As shown in FIG. 8A and FIG. 8B, the middle part 111 of the third connecting rod 11 is provided with a through hole 112, for accommodating the other end 91 of the first connecting rod 9 and the other end 101 of the second connecting rod 10 therein, so that the other end 91 of the first connecting rod 9 and the other end 101 of the second connecting rod 10 overlap with each other. The sum of the thickness of the other end 91 of the first connecting rod 9 and the thickness of the other end 101 of the second connecting rod 10 can be equal to the height of the through hole 112 arranged in the middle part 111 of the third connecting rod 11. The middle part 111 of the third connecting rod 11 is further provided with a bolt connecting hole 113 for aligning with the bolt connecting hole 92 on the other end 91 of the first connecting rod 9 and the bolt connecting hole on the other end 101 of the second connecting rod 10, and they are fixed by a bolt.

Figure 9:
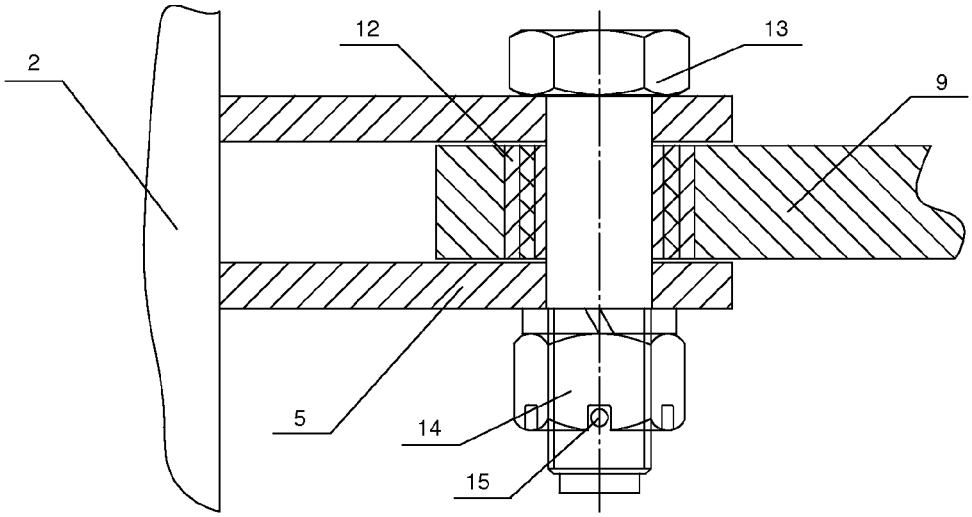
FIG. 9 is a structural schematic diagram of elastic connection between the first connecting rod and a support bracket of the freight car bogie of the present invention.

FIG. 9 is a structural schematic diagram of elastic connection between the first connecting rod 9 and the support bracket 5 of the freight car bogie of the present invention. As shown in FIG. 9 together with FIG. 7A, FIG. 7B, FIG. 8A and FIG. 8B, the elastic connection is realized by the following steps: placing a rubber bush 12 into the bolt connecting hole 92 on the first upper end 41 at one end of the first connecting rod 9, inserting the first connecting rod 9 into the support bracket 5, aligning holes of support bracket 5 with the hole of the rubber bush 12, passing through holes of support bracket 5 from top to down by a bolt 13, adding a washer, tightening a nut 14 on the bolt 13 to obtain a bolted connection, and inserting a cotter pin 15 below the nut 14 to prevent the bolt from loosening. The bolted connection mode not only can realize the elastic connection, but also prevent the bolt from loosening. It should be noted that the connection between the first lower end 43 at one end of the second connecting rod 10 and the support bracket 5, and the connection between the second upper end 42 as well as the second lower end 43 of the third connecting rod 11 and the support brackets 5 are the same as the connection between the first connecting rod 9 and the support bracket 5 as shown in FIG. 9. Therefore, no further discussions will be given here.

Figure 10:
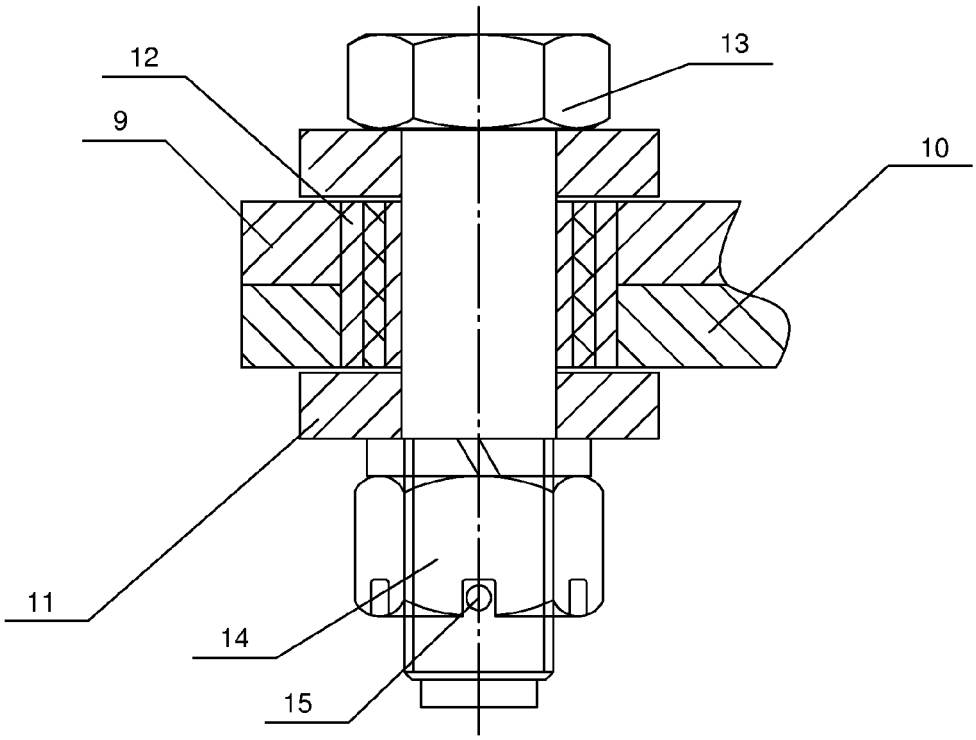
FIG. 10 is a structural schematic diagram of elastic connection among the first connecting rod, the second connecting rod and middle part of the third connecting rod of the freight car bogie of the present invention.

FIG. 10 is a structural schematic diagram of elastic connection among the first connecting rod, the second connecting rod and middle part of the third connecting rod of the freight car bogie of the present invention. As shown in FIG. 10, together with FIG. 7A, FIG. 7B, FIG. 8A and FIG. 8B, the elastic connection is realized by the following steps: placing a rubber bush 12 into the bolt connecting hole 92 on the other end 91 of the first connecting rod 9 and the bolt connecting hole 92 on the other end 101 of the second connecting rod 10 respectively, inserting the other end 91 of the first connecting rod 9 and the other end 101 of the second connecting rod 10 into the middle part 111 of the third connecting rod 11 so that the holes of the rubber bush 12 of the first connecting rod 9 and the second connecting rod 10 are aligned with the bolt connecting hole 113 in the middle part 111 of the third connecting rod 11, passing through these holes by a bolt 13, adding a washer, tightening a nut 14 on the bolt 13 to obtain a bolted connection, and inserting a cotter pin 15 below the nut 14 to prevent the bolt from loosening. The bolted connection mode not only can realize the elastic connection, but also prevent the bolt from loosening.

The freight car bogie provided in the present invention can prevent the bogie from the lozenge distortion by adopting the K-shaped supporting device passing through preset holes on two sides of the abdominal region of the bolster, and thereby improve the running stability of the car. The present invention optimizes the structure of the bolster with the aid of the K-shaped supporting device passing through the preset holes on two sides of the abdominal region of the bolster, so that the K-shaped supporting device does not pass through the middle part of the bolster, and a structure accordingly, which can improve the strength of the bolster for bearing the vertical load, is additionally arranged in the middle part of the bolster. Thereby, the present invention reduces the deadweight of the whole freight car without the requirement of increasing the wall thickness of the bolster. Accordingly, the present invention can change the vertical and the horizontal dynamic performance of the car, improve the curve negotiation performance, increase the motion critical speed of the bogie, reduce the wear between wheel and rail, etc.

The present invention further provides a freight car, which comprises a car body and the freight car bogie as described in the above embodiment, and the freight car bogie is used for supporting the car body. The deadweight of the whole freight car provided in the present invention can be reduced, and thereby the vertical and the horizontal dynamic performance of the car can be changed.

Finally, it should be understood that the above embodiments are only used to explain, but not to limit the technical solution of the present invention. It should be understood by those of ordinary skill in the art that although the present invention has been described in detail with reference to the foregoing embodiments, modifications or equivalent replacements can be made to the technical solutions of the present application, as long as such modifications or replacements do not cause the essence of corresponding technical solutions to depart from the scope of the present invention.

What is claimed is:

1. A freight car bogie, comprising:

two wheel sets;

two side frames arranged at outer side of said wheel sets; and a bolster fixedly connected to center position of each of said two side frames, respectively, wherein the freight car bogie further comprises a K-shaped supporting device, said K-shaped supporting device passes through preset holes on two sides of an abdominal region of said bolster; a first upper end and a second upper end, as well as a first lower end and a second lower end of said K-shaped supporting device are elastically connected with said two side frames respectively; and said first upper end and second upper end, and said first lower end and second lower end are respectively symmetrical with respect to a centre line of said bolster, and wherein said K-shaped supporting device comprises a first connecting rod, a second connecting rod and a third connecting rod, wherein one end of said first connecting rod is said first upper end, one end of said second connecting rod is said first lower end, two ends of said third connecting rod are said second upper end and said second lower end respectively, and the other end of said first connecting rod and the other end of said second connecting rod are elastically connected with a middle part of the third connecting rod, respectively.

2. The freight car bogie according to claim 1, wherein each of said two side frames is fixedly provided with two support brackets which are symmetrical with respect to the centre line of said bolster, and said first upper end and second upper end, as well as said first lower end and second lower end are elastically connected with four support brackets, respectively.

3. The freight car bogie according to claim 2, wherein said four support brackets are welded or riveted with said side frames.

4. The freight car bogie according to claim 1, wherein a plane in which the K-shaped supporting device is positioned is close to and parallel with a plane in which center lines of axles of said two wheel sets are positioned.

5. The freight car bogie according to claim 1, wherein said bolster is provided with a reinforcing rib in a middle part thereof, and said reinforcing rib is positioned in a middle position between the preset holes on two sides of the abdominal region of said bolster.

6. The freight car bogie according to claim 1, wherein said third connecting rod has a through hole in the middle part thereof, for accommodating the other end of said first connecting rod and the other end of said second connecting rod therein, so that the other end of said first connecting rod and the other end of said second connecting rod overlap with each other.

7. The freight car bogie according to claim 1, wherein the elastic connection is a bolted connection among a screw hole, a bolt and a nut, and a cotter pin is inserted below said nut to prevent the bolt from loosening.

8. A freight car, comprising a car body and a bogie, wherein the bogie is said freight car bogie in claim 1.

9. The freight car bogie according to claim 1, wherein the preset holes on two sides of the abdominal region of said bolster do not pass through a central part of the bolster and keep a certain distance with the central part.

10. A freight car bogie, comprising:

two wheel sets;

two side frames arranged at outer side of said wheel sets; and a bolster fixedly connected to center position of each of said two side frames, respectively, wherein the freight car bogie further comprises a K-shaped supporting device, said K-shaped supporting device passes through preset holes on two sides of an abdominal region of said bolster; a first upper end and a second upper end, as well as a first lower end and a second lower end of said K-shaped supporting device are elastically connected with said two side frames respectively; and said first upper end and second upper end, and said first lower end and second lower end are respectively symmetrical with respect to a centre line of said bolster, and wherein the preset holes on two sides of the abdominal region of said bolster do not pass through a central part of the bolster and keep a certain distance with the central part.

11. The freight car bogie according to claim 10, wherein each of said two side frames is fixedly provided with two support brackets which are symmetrical with respect to the centre line of said bolster, and said first upper end and second upper end, as well as said first lower end and second lower end are elastically connected with four support brackets, respectively.

12. The freight car bogie according to claim 11, wherein said four support brackets are welded or riveted with said side frames.

13. The freight car bogie according to claim 12, wherein said K-shaped supporting device comprises a first connecting rod, a second connecting rod and a third connecting rod, wherein one end of said first connecting rod is said first upper end, one end of said second connecting rod is said first lower end, two ends of said third connecting rod are said second upper end and said second lower end respectively, and the other end of said first connecting rod and the other end of said second connecting rod are elastically connected with a middle part of the third connecting rod, respectively.

14. The freight car bogie according to claim 11, wherein said K-shaped supporting device comprises a first connecting rod, a second connecting rod and a third connecting rod, wherein one end of said first connecting rod is said first upper end, one end of said second connecting rod is said first lower end, two ends of said third connecting rod are said second upper end and said second lower end respectively, and the other end of said first connecting rod and the other end of said second connecting rod are elastically connected with a middle part of the third connecting rod, respectively.

15. The freight car bogie according to claim 14, wherein said third connecting rod has a through hole in the middle part thereof, for accommodating the other end of said first connecting rod and the other end of said second connecting rod therein, so that the other end of said first connecting rod and the other end of said second connecting rod overlap with each other.

16. The freight car bogie according to claim 14, wherein the elastic connection is a bolted connection among a screw hole, a bolt and a nut, and a cotter pin is inserted below said nut to prevent the bolt from loosening.

17. The freight car bogie according to claim 10, wherein a plane in which the K-shaped supporting device is positioned is close to and parallel with a plane in which center lines of axles of said two wheel sets are positioned.

18. The freight car bogie according to claim 17, wherein said K-shaped supporting device comprises a first connecting rod, a second connecting rod and a third connecting rod, wherein one end of said first connecting rod is said first upper end, one end of said second connecting rod is said first lower end, two ends of said third connecting rod are said second upper end and said second lower end respectively, and the other end of said first connecting rod and the other end of said second connecting rod are elastically connected with a middle part of the third connecting rod, respectively.

19. The freight car bogie according to claim 10, wherein said bolster is provided with a reinforcing rib in a middle part thereof, and said reinforcing rib is positioned in a middle position between the preset holes on two sides of the abdominal region of said bolster.

20. The freight car bogie according to claim 19, wherein said K-shaped supporting device comprises a first connecting rod, a second connecting rod and a third connecting rod, wherein one end of said first connecting rod is said first upper end, one end of said second connecting rod is said first lower end, two ends of said third connecting rod are said second upper end and said second lower end respectively, and the other end of said first connecting rod and the other end of said second connecting rod are elastically connected with a middle part of the third connecting rod, respectively.

* * * * *